United States Patent [19]

Rynne

[11] 4,388,160

[45] * Jun. 14, 1983

[54] ZINC-NICKEL ALLOY ELECTROPLATING PROCESS

[76] Inventor: George B. Rynne, Rt. 1, Box 150D, Chatsworth Hwy., Ellijay, Ga. 30540

[ * ] Notice: The portion of the term of this patent subsequent to Aug. 25, 1998, has been disclaimed.

[21] Appl. No.: 295,758

[22] Filed: Aug. 24, 1981

Related U.S. Application Data

[63] Continuation-in-part of Ser. No. 123,109, Feb. 20, 1980, Pat. No. 4,285,802.

[51] Int. Cl.[3] ..... C25D 3/56; C25D 5/48

[52] U.S. Cl. ..... 204/38 R; 204/43 Z

[58] Field of Search ..... 204/43 Z, 43 T, 38 R

[56] References Cited

U.S. PATENT DOCUMENTS

| | | | |
|---|---|---|---|
| 2,419,231 | 4/1947 | Schantz | 204/43 Z X |
| 2,989,446 | 6/1961 | Hammond et al. | 204/41 |
| 3,064,337 | 11/1962 | Hammond et al. | 204/43 Z X |
| 3,420,754 | 1/1969 | Roehl | 204/28 |
| 3,558,442 | 1/1971 | Roehl et al. | 204/28 |
| 4,104,133 | 8/1978 | Brannan et al. | 204/25 |
| 4,285,802 | 8/1981 | Rynne | 204/43 Z |

OTHER PUBLICATIONS

J. W. Dini et al., Metal Finishing, pp. 31–33, Aug. 1979.

J. W Dini et al., Metal Finishing, pp. 53–57, Sep. 1979.

*Primary Examiner*—G. L. Kaplan

[57] ABSTRACT

An acid electroplating process is disclosed for codepositing zinc and nickel to provide bright lustrous ductile zinc-nickel alloy electrodeposits containing no more than a few percent by weight of nickel which deposits have good receptivity to chromate conversion coatings and which, after post treatment, have drastically improved corrosion resistance. The preferred plating baths as disclosed include a soluble zinc salt, a soluble nickel salt, an ammonium salt, an alkali metal salt, a nonionic polyoxyalkylated surfactant, and an aromatic aldehyde. The plating bath can be free of ammonium ions when it contains boric acid and an aromatic carbonyl compound.

18 Claims, No Drawings

ZINC-NICKEL ALLOY ELECTROPLATING PROCESS

This application is a continuation in part of application Ser. No. 123,109 filed Feb. 20, 1980 and now U.S. Pat. No. 4,285,802.

TECHNICAL FIELD

The present invention relates to electroplating baths, and more particularly to such baths for producing a bright zinc-nickel alloy electroplated deposit.

BACKGROUND OF THE INVENTION

Electrodeposition of metals on ferrous and nonferrous substrates is a well known method for providing corrosion protection and for providing improved cosmetic appearance. Heretofore, such electrodeposition has been carried out by essentially two types of electroplating baths.

One such electroplating bath is cyanide-based. However, the use of cyanide electrolytes present significant ecological problems and require expensive waste treatment equipment. Moreover, cyanide baths are toxic and tend to embrittle certain sheets and exhibit low current efficiencies.

In an effort to overcome the deficiencies of the cyanide baths, chloride-based baths of three types were developed. The three types of baths were termed neutral, ammonia-based and non-ammonia-based. Although the chloride-based baths eliminate the toxicity problem of the cyanide baths, these baths also have other limitations. The neutral and ammonia-based baths contain excessive amounts of ammonium ions and/or chelates, thereby making metal removal costly and difficult. The non-ammonia-based baths generally result in deposits which are brittle at thicknesses over 0.5 mils and which tend to flake at thicknesses less than 0.5 mils. Furthermore, iron co-deposition, which causes a dull appearance and poor corrosion protection, is a problem with all chloride-based baths.

Examples of such chloride-based zinc baths are discussed in detail in U.S. Pat. Nos. 3,694,330; Re 27,999; 3,729,394; 3,730,855; 3,778,359; 3,787,297; 3,838,026; 3,855,085; 3,928,149; 4,070,256; 4,075,066; 4,089,755 and 4,119,502 (all incorporated herein by reference). The acid zinc and neutral zinc plating baths disclosed in these patents relate to electroplating of zinc, rather than a zinc-nickel alloy, and the deposited zinc plate is necessarily thin and has poor corrosion resistance unless it is protected by appropriate post treatment. The established products in the plating industry is to post treat all zinc electroplate to provide a chromate conversion coating, such as described in U.S. Pat. Nos. 3,694,330; 3,919,056 and 4,119,502. The pure zinc electroplate has good receptivity to conventional chromate conversion coatings which greatly enhance the corrosion resistance. Best corrosion protection is obtained when using thicker highly colored coatings or iridescent chromate coatings, but the more transparent, lighter colored coatings, such as the blue chromates, enhance the luster and are preferred for decorative eye appeal in spite of the inferior corrosion protection.

Heretofore the electroplating industry was not aware of any practical economical process for substantially increasing the corrosion resistance of chromated bright zinc plate, and, therefore, the utility of articles provided with such plate was necessarily limited, although the protection could be improved by use of lacquer coatings and the like.

SUMMARY OF THE INVENTION

The present invention provides a process for producing a bright zinc-nickel alloy electroplate with remarkable resistance to corrosion. The plating bath employed in the process includes a soluble zinc salt, a soluble nickel salt, a conducting salt or electrolyte, a polyoxyalkylate wetting agent or surfactant, and an aromatic carbonyl brightener. The ingredients are selected to cause co-deposition of the zinc and the nickel to form a bright lustrous zinc-nickel alloy electroplate with vastly improved corrosion resistance. The electrolyte is an alkali metal salt and/or an ammonium salt. The wetting agent or surfactant is preferably a polyoxyethylene compound with at least 10 ethylene oxide groups in the molecule. The brightener is preferably an aromatic aldehyde.

In one embodiment of the invention the bath includes a soluble zinc salt, a soluble nickel salt, an ammoniated electrolyte, a non-ammoniated electrolyte, a nonionic polyoxyalkylate surfactant, and an aromatic carbonyl brightener, such as an aromatic aldehyde.

In another embodiment of the present invention, the ammoniated electrolyte is omitted and replaced by boric acid and an aromatic carbonyl compound to provide an ammonia-free bath free of ammonium ions.

The metal salts and the wetting agent are selected to minimize the difference in the deposition potentials of the zinc and the nickel and to permit effective alloy co-deposition to produce an alloy electroplate with an alloy average nickel content no more than a few percent by weight, which alloy has good receptivity to conventional chromate conversion coatings. To this end, sulfate ions from sulfuric acid or other compounds are preferably avoided. For some reason the desired alloy codeposition is facilitated by combining a polyoxyethylene surfactant, an alkali metal salt, an ammonium salt, and an aromatic carbonyl compound.

The zinc-nickel alloy electrodeposits obtained by practice of the present invention having an alloy average nickel content of 1 to 4 percent, when subjected to the standard post treatment to provide a chromate conversion coating, having a vastly improved corrosion resistance which may seen incredible in view of the small amount of nickel involved.

Because it is possible to increase the corrosion resistance of a fully bright decorative electroplate from 70 to 100 percent or more by use of the present invention without a material increase in the cost of the electroplating chemicals, it becomes practical to employ zinc plating in areas never before considered. For example, one bicycle manufacturer has eliminated the need for the usual chrome plating of wheel rims, handlebars and other bicycle parts by applying the zinc-nickel alloy electroplate, followed by a blue chromate conversion coating, to obtain a mirror-bright surface and then applying a lacquer coating to further improve the corrosion resistance.

It is an object of the present invention to provide a simple, economical process for codepositing zinc and nickel to provide a bright ductile adherent zinc-nickel alloy plate with vastly improved corrosion resistance and good receptivity to chromate conversion coatings.

Another object of the present invention is to provide a reliable versatile zinc electroplating process which consistently produces bright alloy plate with high luster and high corrosion resistance over a broad range of current density and over a broad range of operating conditions as are normally encountered in barrel plating operations in spite of substantial drag out losses.

Another object of the invention is to provide a zinc-nickel electroplating bath which produces a zinc-nickel alloy electrodeposit which resists flaking at relatively thin deposition thicknesses and which possesses excellent ductibility at relatively thick deposition thicknesses.

Another object of the present invention is to provide a zinc-nickel electroplating bath which reduces or substantially eliminates iron co-deposition.

These and other objects, features and advantages of the present invention will become apparent from a review of the following detailed description of the disclosed embodiment and the appended claims.

DETAILED DESCRIPTION OF THE PREFERRED EMBODIMENTS

The zinc-nickel electroplating bath of the present invention can be ammonia-containing or ammonia-free. The ammonia-containing bath will be considered first.

The preferred ammonia-containing bath of the present invention includes, in aqueous solution, a soluble zinc salt, a soluble nickel salt, an ammoniated electrolyte, such as ammonium chloride, a non-ammoniated electrolyte, such as potassium chloride or sodium chloride, a polyoxyalkylated surfactant, preferably a non-ionic polyoxyethylene compound containing at least 10 ethylene oxide groups, and an aromatic carbonyl brightener, such as an aromatic aldehyde.

The soluble zinc compounds useful in the bath of the present invention are zinc chloride, zinc oxide and mixtures thereof. The soluble zinc compound or salt is present in the solution in an amount which provides between approximately 10 and 100 grams of zinc as metal per liter of solution; preferably between 50 and 80 grams per liter of solution. Generally, it is found that at concentrations of zinc metal ions in the solution of less than approximately 10 grams per liter, poor deposition efficiency results. At concentrations of zinc metal ions in the solution greater than approximately 100 grams per liter, the zinc salt has poor solubility in the solution and deposition is uneconomical.

The soluble nickel salt useful in the bath of the present invention is nickel chloride. The soluble nickel salt is present in the solution in an amount which provides between approximately 0.01 and 10 grams of nickel as metal per liter of solution; preferably between 3 and 5 grams per liter of solution. Generally, it is found that at concentrations of nickel metal ions in the solution of less than 0.01 grams per liter, virtually no codeposition of the nickel results; whereas, there is excessive iron co-deposition. At concentrations of nickel metal ions in the solution greater than approximately 10 grams per liter, excessive codeposition of nickel results, thereby causing poor post-plate treatment and reduced corrosion resistance.

In a barrel plating operation, for example, the average concentration of nickel metal ions in the plating bath solution is preferably in the range of 3 to 10 grams per liter and such that the zinc-nickel alloy electrodeposits contain at least 96 percent of zinc and no more than 4 percent by weight of nickel. The concentration of nickel ions must be limited so that the usual post-plate chromate treatment will be effective in increasing the corrosion resistance.

The ammoniated electrolyte useful in the present invention is ammonium chloride which is the soluble ammonium salt of hydrochloric acid. The ammonium chloride is present in an amount which provides between approximately 1 and 10 grams of ammonium ions per liter of solution; preferably 5 or more grams per liter. Generally, it is found that at concentrations of ammonium ions in the solution of less than approximately 1 gram per liter, the addition of boric acid is required as if the bath were ammonia-free, as will be discussed in more detail hereinbelow. At concentrations of ammonium ions greater than approximately 10 grams per liter, the ammonium ion causes difficulty in the removal of heavy metals from effuents with conventional waste treatment systems.

The non-ammoniated electrolytes useful in the present invention are potassium chloride, sodium chloride and mixtures thereof. It should be noted that calcium chloride is not useful as a non-ammoniated electrolyte in the present invention. The non-ammoniated electrolyte is present in the solution in an amount which provides between approximately 25 and 300 grams of chloride ions per liter of solution, preferably between approximately 200 and 250 grams of chloride ions per liter of solution. Generally, it is found that at concentrations of chloride ions from the non-ammoniated electrolyte less than approximately 25 grams per liter, electrical conductivity is poor. At concentrations of chloride ions from the non-ammoniated electrolyte greater than approximately 300 grams per liter, solubility of the non-ammoniated electrolyte in the bath is difficult and the bath is uneconomical.

The polyoxyalkylated surfactants employed in the practice of this invention are made from ethylene oxide and preferably contain at least 10 ethylene oxide groups in the molecule. They are preferably nonionic surfactants or compounds made from nonionic polyoxyethylene surfactants, such as those disclosed in U.S. Pat. Nos. 3,694,330; 3,773,630; 3,778,359; 3,928,149 and 4,075,066.

The polyoxyalkylated surfactants useful in the present invention include non-ionic block copolymers: of ethylene oxide and linear alcohols, of ethylene oxide and phenol alcohols, of ethylene oxide and coconut fatty acids and mixtures thereof; and they include others disclosed in U.S. Pat. Nos. 3,694,330 and 4,070,256. The condensation products of these materials preferably contain between approximately 15 and 50 moles of ethylene oxide per mole of alcohol or fatty acid.

Non-ionic block copolymers of ethylene oxide and linear alcohols useful in the present invention have the following structural formula:

$$\begin{array}{l} CH_3-(CH_2)_x-CH_3 \\ \quad\quad\quad\;\; | \\ \quad\quad\quad\;\; O-(CH_2-CH_2O)_n-H \end{array}$$

wherein x is an integer from 9 to 15 and n is an integer from 10 to 50. Surfactants of the foregoing structure are members of the Tergitol S Series available from Union Carbide. Examples of those useful surfactants are Tergitol Nonionic 15-S-3, Tergitol Nonionic 15-S-5, Tergitol Nonionic 15-S-7, Tergitol Nonionic 15-S-9 and Tergitol Nonionic 15-S-12.

Non-ionic block copolymers of ethylene oxide and phenol alcohols useful in the present invention have the following structural formula:

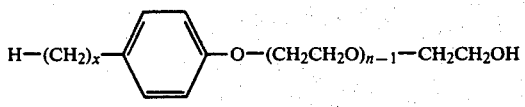

wherein x is an integer from 6 to 15 and n is an integer from 10 to 50. Surfactants of the foregoing structure are members of the Igepal CO surfactants available from GAF Corporation (Igepal is the registered trademark of GAF Corporation).

The Coconut fatty acids generally have the following structural formula:

$$C_nH_{2n+1}COOH$$

wherein n is an integer from 5 to 17. Coconut fatty acids are derived from the hydrolysis of coconut oil. Coconut fatty acids are well known in the art for their use as surfactants.

Non-ionic block copolymers of ethylene oxide and monoethanol amine coconut fatty acid, condensates useful in the present invention are prepared, for example, by condensing 5 moles of ethylene oxide with each mole of the monoethanol amide-coconut fatty acid. The resulting condensation product with a molecular weight of approximately 475 and an ethylene oxide content of approximately 46% weight percent thereof is well suited for use in the practice of this invention.

Other specific examples of non-ionic polyoxyalkylated surfactants useful in the present invention include, for example, alkoxylated alkyl phenols, e.g., nonylphenol; alkyl naphthols; aliphatic monohydric alcohols; aliphatic polyhydric alcohols, e.g., polyoxypropylene glycol; ethylene diamine; fatty acids, fatty amids, e.g., amide of coconut fatty acid; or esters, e.g., sorbitan monopalmitate. These and other suitable surfactants are disclosed in U.S. Pat. Nos. 4,070,256 and 4,075,066. Exemplary alkoxylated compounds within the above classes which are commercially available include "Igepal" CA 630, trade name for an ethoxylated octyl phenol, available from the GAF Corporation; Igepal CO-880, trade name for an ethoxylated nonyl phenol; "Brij" 98, trade name for an ethoxylated oleyl alcohol available from ICI America, Inc.; "Pluronic" F68, trade name for a polyoxyethylenepolyoxypropylene glycol available from BASF Wyandotte Corp.; "Surfynol" 485, trade name for ethoxylated 2,4,7,9-tetramethyl-5-decyne-4,7-diol available from Air Products and Chemicals, Inc.; "Tetronic" 504, trade name for an ethoxylated propoxylated ethylene diamine available from BASF Wyandotte Corp.; "Myrj" 525, trade name for an ethoxylated stearic acid available from ICI America, Inc.; "Amidox" C-5, trade name for a polyethoxylated coconut acid monoethanolamide available from Stepan Chemical Co.; "Tween" 40, trade name for an ethoxylated sorbitan palmitate available from ICI America, Inc.; and "Triton X-165", trade name for an ethoxylated octyl phenol available from Rohm and Haas Co.

The polyoxyalkylated surfactants are present in the solution in an amount between approximately 5 and 50 grams per liter of solution; preferably between 10 and 15 grams per liter. Generally, it is found that at concentrations of surfactant less than approximately 5 grams per liter, a poor plating range and coarse deposits result. At concentrations of surfactant greater than approximately 50 grams per liter, solubility of the surfactant is poor and the bath is uneconomical.

Improved results can be obtained by employing more than one surfactant, such as a non-ionic surfactant in combination with an anionic and/or amphoteric surfactant. Various surfactant combinations are useful in acid zinc plating as disclosed, for example, in U.S. Pat. Nos. 3,730,855; 3,787,297; 3,855,085; 4,070,256 and 4,075,066. The baths used in the practice of the present invention may incorporate such surfactant combinations and may include various anionic, nonionic, cationic and amphoteric surfactants useful in acid zinc plating such as Katapol PN-430 (GAF Corp.), Igepal CA-640; Darvon No. 1, Daxad, Triton QS-15, Renex 650, Neutronyx 640, Surfynol 465 or 485, imidazoline derivatives, and other surfactants, such as disclosed in U.S. Pat. Nos. 4,075,066; 4,089,755 and 4,119,502. Imidazoline surfactants and surfactant combinations which may be useful in the plating baths of this invention are disclosed in U.S. Pat. Nos. 3,729,394; 3,730,855; 3,787,297 and 3,919,056.

In order to obtain a bright lustrous alloy electroplate, it is necessary to employ an aromatic carbonyl brightener. Such brighteners are commonly used in acid zinc plating and are disclosed in U.S. Pat. Nos. 3,694,330; 3,773,630; 3,787,297; 3,729,394; 3,928,149; 4,070,256 and 4,075,066, which are incorporated herein by reference. The brightener is preferably an aromatic aldehyde or an aromatic aldehyde in combination with an aromatic ketone.

All aromatic aldehydes known for use in acid zinc plating are believed useful as brighteners in the present invention and specifically include all aryl aldehydes, all ring-halogenated aryl aldehydes and heterocyclic aldehydes. Preferred aromatic aldehydes include orthochlorobenzaldehyde, para-chlorobenzaldehyde, orthoanisaldehyde, thiophene aldehyde and others disclosed in the above patents.

The aromatic aldehydes or other aromatic carbonyl brighteners are present in the bath in an amount between approximately 0.05 and 4 grams per liter of solution; preferably between approximately 0.5 and 1.5 grams per liter of solution. Generally, it is found that at concentration of aromatic aldehyde less than approximately 0.05 grams per liter, no significant brightening effect results; whereas, at concentrations above approximately 4 grams per liter, brittle deposits and nonuniform plating results.

The pH of the zinc-nickel ammonia-containing electroplating bath useful in the present invention is between approximately 3.0 and 6.9 and is preferably in the normal range disclosed in U.S. Pat. No. 3,694,330. Boric acid, which acts as a buffer and also helps keep the zinc metal ions in solution, can optionally be added to the ammonia-containing bath to adjust the pH to the desired range.

The pH of the bath and the bath formulations are preferably selected to provide a versatile bath which operates well over a wide range of operating conditions. In some baths, the choice of brighteners is important, and it is preferable to employ a combination of an aromatic aldehyde and an aromatic carboxylic acid of the type disclosed in U.S. Pat. Nos. 3,778,359; 3,928,149 and 4,075,066. This is more important in the plating baths which are free of ammonium ions or which contain, for example, less than 5 grams per liter of ammonium chloride.

The ammonia-free bath of the present invention is different from the foregoing-described ammonia-containing bath in that the ammoniated electrolyte is eliminated and substituted therefor are boric acid and an aromatic carbonyl compound.

Boric acid, which acts as a buffer and a high current density grain refiner, is added to the ammonia-free bath and helps to keep the zinc ions in solution. The boric acid is present in the ammonia-free bath in an amount between approximately 10 and 40 grams per liter of solution; preferably between approximately 25 and 30 grams per liter. Generally, it is found that concentrations of boric acid below approximately 10 grams per liter does not provide sufficient buffering and causes zinc metal to be in a non-platable ionic state; whereas, at concentrations above approximately 40 grams per liter, boric acid has poor solubility in the solution.

The aromatic carbonyl compounds used in the present invention include benzoic acid, salicylic acid and other compounds disclosed in U.S. Pat. Nos. 3,694,330; 3,778,359; 3,855,085; 3,928,149; 4,070,256 and 4,075,066. It is preferable to employ a nonocarboxylic aromatic acid (or salt thereof) having a carboxyl group bonded directly to the aromatic nucleus as disclosed in Pat. No. 3,778,359. The preferred aromatic carbonyl compounds used in the ammonia-free plating baths of this invention include benzoic acid, nicotinic acid and cinnamic acid.

The major contribution of the carbonyl compound in the bath of the present invention is to provide platable ion concentration control. The aromatic carbonyl compound is present in the ammonia-free bath of the present invention in an amount between approximately 1.5 and 15 grams per liter of solution.

The pH of the zinc-nickel ammonia-free electroplating bath useful in the present invention is between approximately 3.0 and 6.9. Potassium hydroxide can be added to electroplating baths of the present invention if the pH of the bath is too low. Similarly, ammonium hydroxide can be added to the ammonia-containing baths to raise the pH to the desired level. Hydrochloric acid can be added to the electroplating baths of the present invention if the pH of the bath is too high. It is generally desirable in the present invention to keep the ions in the electroplating bath as compatible as possible. Therefore, sodium hydroxide and sulfuric acid are not recommended for use in the present invention.

In the absence of substantial amounts of a complexing agent such as ammonium chloride or citric acid to help keep the zinc ions in solution, it is best to employ a mildly acid bath, such as disclosed in U.S. Pat. No. 4,075,066, or to operate in the normal acid range as disclosed in U.S. Pat. No. 3,694,330. Best results are usually obtained when employing a pH from about 4 to about 5.

By using ammonium salts or other complexing agents, such as citric acid or other polyhyroxycarboxylic compounds disclosed in U.S. Pat. Nos. 3,694,330; 3,730,855; 3,773,630 and 3,787,297, the process of this invention can be practiced with "neutral" plating baths, but the use of substantial amounts of complexing agents is undesirable for ecological reasons.

During electrodeposition of the baths of the present invention, the temperature of the baths is preferably maintained between approximately 10° and 30° C. As the temperature of the bath is increased, there is a tendency for the minimum current density for satisfactory plating to increase, and a simultaneous increase in the maximum current density at which satisfactory plating can be obtained.

Ammonium chloride functions as a buffer and, therefore, plating baths made according to this invention containing substantial amounts of ammonium chloride do not require buffers, such as boric acid or acetic acid.

The plating baths used in the process of this invention are described in my Pat. No. 4,285,802, the disclosure of which is incorporated herein by reference. These baths are capable of producing zinc-nickel alloy electroplate deposits with a nickel content, such as 1 to 4 percent, and with excellent receptivity to chromate post treatment which, when provided with a chromate conversion coating, have a corrosion resistance which is vastly improved (that is, improved at least 50 percent with respect to a comparable standard zinc electroplate deposit of the same thickness).

The present invention produces bright ductile adherent zinc-nickel alloy deposits on all types of metals and alloys and is capable of providing alloy electroplate deposits with consistently high resistance to corrosion. The conventional salt spray tests indicate that the improvement in corrosion resistance measured after the chromate conversion treatment is usually 70 to 100 percent or more as compared to comparable zinc plated articles. Because this can be accomplished with zinc-nickel alloy electroplate containing only 0.5 to 3 percent by weight of nickel, the cost of the nickel is not significant and the plating process is very reliable.

It will be understood that the plating baths used in the practice of this invention may include various additives commonly used in acid zinc baths including "Cellosolve" (ethylene glycol monoethyl ether), dimethyl sulfoxide, and other solvents or additives, such as are disclosed in U.S. Pat. Nos. 3,855,085; 4,075,066 and 4,089,755.

The wetting agents used in the baths may include cationic surfactants and surfactant combinations as disclosed in U.S. Pat. No. 4,089,755, or amphoteric surfactants, but better results are obtained using nonionic and/or anionic surfactants based on ethylene oxide and having a substantial number of ethylene oxide groups in the molecule as disclosed, for example, in U.S. Pat. Nos. 3,694,330 and 3,773,630.

The surfactants may also contain propylene oxide groups. Interpolymers of ethylene oxide and propylene oxide, such as disclosed in U.S. Pat. Nos. 3,017,333; 3,729,394; 3,855,085; 3,928,149; and 4,075,066, are well suited for use in the plating baths of this invention, particularly when used in combination with another surfactant, such as a nonionic or anionic surfactant. Usually the zinc plating baths can be improved by use of special combinations of surfactants instead of a single surfactant.

The examples which follow indicate that the electroplating baths used in the practice of this invention may employ widely varying formulations, but in commercial operation, it is preferable to use a preferred formulation with chloride ion concentrations comparable to standard acid zinc baths. Thus, the chloride ion concentration is preferably at least 200 grams per liter as provided by the zinc chloride and the chloride electrolyte. As indicated in Pat. No. 4,089,755, the concentration of the conducting salt in an acid zinc bath should substantially exceed that of the zinc salt. The same is true in the plating baths of this invention where the amount of the alkali metal chloride electrolyte in grams per liter substantially exceeds the amount of zinc chloride and is preferably many times the amount of nickel chloride or ammonium chloride. In a commercial bath, the amount of zinc chloride in grams per liter is at least several times that of the nickel chloride and at least 30 and preferably at least 50 grams per liter. In a barrel plating operation, for example, the average amount of nickel chloride may be from 3 to 10 grams per liter and the average amount of ammonium chloride may be 5 to 10 grams per liter. For high corrosion protection, the amount of nickel chloride is selected to provide an alloy electroplate deposit containing at least 0.5 percent by weight of nickel.

The following examples are provided to illustrate, but not to limit, the present invention. All temperatures are given in degrees Calsius and all amounts are grams per liter of aqueous solution unless specifically stated otherwise.

EXAMPLE 1

An aqueous bath is prepared containing 70 grams per liter of zinc chloride, 5 grams per liter of nickel chloride, 10 grams per liter of ammonium chloride, 200 grams per liter of potassium chloride, 12 grams per liter of ethoxylated nonyl phenol alcohol and 1 gram per liter of orthochlorobenzaldehyde. The pH of the bath is about 4.5.

A series of Hull cell panels is plated at 3.0 amps. for a period of three minutes without agitation while the bath is maintained at a temperature of about 20° C. The resulting panels are found to have lustrous deposits of zinc-nickel alloy through a plating range of 1–40 a.s.f. (amperes per square foot). At currents over 40 a.s.f., the deposit is dull gray and burning. Bend tests at deposit thicknesses of 0.5 mils are excellent. The deposit contained an average alloy nickel content of 2 percent to 3 percent.

The pH of the bath is adjusted to about 3.0 by the addition of hydrochloric acid and a further series of panels is run at the same conditions. Again bright, lustrous deposits are produced over a range of 1–40 a.s.f.

EXAMPLE 2

An aqueous bath is prepared containing 60 grams per liter of zinc chloride, 3 grams per liter of nickel chloride, 250 grams per liter of potassium chloride, 20 grams per liter of boric acid, 3 grams per liter of cinnamic acid, 15 grams per liter of ethoxylated isononyl alcohol and 0.05 grams per liter of para-chlorobenzaldehyde. The pH of the bath is about 4.0.

The bath is employed in a commercial plating tank for rack plating of steel alloy parts having various dimensions and geometric configurations. The bath is maintained at a temperature of about 25° C. The plating range varies between 1 and 60 a.s.f. and lustrous deposits are produced over the entire range. The deposits are found to be ductile and adherent. The alloy average nickel content is about 1 percent to 2 percent.

EXAMPLE 3

A bath is prepared containing the following compounds on a per liter basis:

| | |
|---|---|
| zinc chloride | 50 grams |
| nickel chloride | 2 grams |
| potassium chloride | 180 grams |
| ammonium chloride | 5 grams |
| ethoxylated tributyl phenol | 10 grams |
| benzoic acid | 4 grams |

-continued

| | |
|---|---|
| ortho-chlorobenzaldehyde | 1 gram |

The pH of the bath is 4.5.

Plating is carried out as in Example 2. Lustrous deposits are produced over a plating range of 1–30 a.s.f. Bend tests at 0.5 mils are excellent. Alloy average nickel content is 1 percent to 2 percent.

EXAMPLE 4

A bath is prepared containing the following compounds on a per liter basis:

| | |
|---|---|
| zinc chloride | 80 grams |
| nickel chloride | 8 grams |
| potassium chloride | 250 grams |
| boric acid | 20 grams |
| benzoic acid | 4 grams |
| ethoxylated nonylphenol alcohol | 35 grams |
| thiopene aldehyde | 1 gram |

The pH of the bath is 4.5.

Plating is carried out as in Example 2. Lustrous deposits are produced over a plating range of 1–60 a.s.f. Bend tests at thicknesses of 0.5 mils are excellent. Alloy average nickel content is 3 percent to 4 percent.

EXAMPLE 5

A bath is prepared containing the following compounds on a per liter basis:

| | |
|---|---|
| zinc chloride | 30 grams |
| nickel chloride | 1 gram |
| sodium chloride | 200 grams |
| ammonium chloride | 5 grams |
| ethoxylated coconut fatty acid | 20 grams |
| nicotinic acid | 2 grams |
| ortho-chlorobenzaldehyde | 1 gram |

The pH of the bath is 4.0.

Plating is carried out as in Example 2. Lustrous deposits are produced over a plating range of 1–30 a.s.f. Average alloy nickel content is 1 percent to 2 percent.

EXAMPLE 6

A bath is prepared containing the following compounds on a per liter basis:

| | | |
|---|---|---|
| zinc chloride | 50–70 | grams |
| nickel chloride | 8–10 | Grams |
| potassium chloride | 170–180 | grams |
| ammonium chloride | 8–10 | grams |
| ethoxylated nonyl phenol alcohol | 10–15 | grams |
| ethoxylated octyl phenol alcohol | 2–3 | grams |
| boric acid | 20+ | grams |
| benzoic acid | 4–6 | grams |
| ortho-chlorobenzaldehyde | 1 | gram |

The pH of the bath is from 4.0 to 5.0, and plating is carried out as in Example 2. Lustrous zinc-nickel alloy electrodeposits are produced over a plating range of 1–40 a.s.f. or greater. The alloy deposits are found to be ductile and adherent have good receptivity to subsequent chromate conversion coating. The alloy average nickel content is from about 2 to 4 percent. The preferred pH is about 4.5, and the temperature is preferably below 30° C.

After plating the parts are rinsed and given a clear chomate conversion coating as is the normal practice in the zinc plating industry. The resulting zinc-nickel alloy electroplate is uniformly bright and lustrous. Conventional salt spray tests indicate that it has excellent corrosion resistance vastly superior to that of comparable zinc electroplate of the same thickness.

The bath of Example 6 can be used to provide bright ductile electrodeposits with a thickness of 0.1 to 0.5 mil or higher. The process of this invention thus makes it possible to further increase corrosion protection by increasing the thickness of the deposits to 0.5 mil or greater.

Each of the plating baths set forth in Examples 1 to 6 can function even though the pH, temperature and operating conditions vary considerably. Each bath can, for example, be operated at a pH from 4.0 to 5.0 or higher. The amount of the aromatic aldehyde brightener in each bath can vary, for example, between 0.5 and 1.5 grams per liter. The amount and type of wetting agent can also be modified.

In each of the Examples, the wetting agent can be a reaction product of ethylene oxide and nonylphenol, such as Igepal CO-880 or the like. The latter surfactant is preferably used in Example 6 in combination with another surfactant, such as Igepal CA-630.

Satisfactory results can also be obtained when the bath employs Pluronic F-68 or other interpolymers of ethylene oxide and propylene oxide known to be useful in acid zinc baths as disclosed in U.S. Pat. Nos. 3,017,333; 3,729,394 and 3,855,085.

The plating bath of Example 6 is well suited for use in barrel plating operations where there is a wide variation in operating conditions and a substantial variation in bath composition due to drag out losses. Excellent results are obtained with this bath even if there is a wide variation in the amount of ammonium chloride and metal chloride. The average ammonium chloride content in this bath is preferably from 5 to 10 grams per liter, and the average nickel chloride content is preferably 3 to 10 grams per liter. The bath is preferably controlled to maintain the nickel content of the zinc-nickel alloy deposits in the range of 1 to 3 percent by weight, but excellent corrosion resistance can be obtained when the nickel content of the alloy is only 0.5 percent by weight.

In order to obtain the desired alloy composition, the amount of zinc chloride must be at least several times the amount of nickel chloride, and the amount of ammonium chloride and nickel chloride must be limited. The amount of the electrolyte (potassium chloride and/or sodium chloride) used in the bath substantially exceeds the amount of zinc chloride and is usually many times that of the ammonium chloride so that the total chloride ion concentration in the bath is at least 200 grams per liter and sufficient for effficient operation.

In rack plating and barrel plating operations, the chemicals are added to the bath as necessary to replace drag out losses and to adjust the pH. Hydrochloric acid may be used to adjust the pH, but sulfuric acid should be avoided in chloride baths to keep them free of sulfate ions. Likewise the use of sodium hydroxide should be avoided.

Generally, it is found that the superior corrosion resistance of the zinc-nickel alloy electroplated deposits of the present invention are provided by electrodeposit compositions of between 96 and 99.9 percent by weight zinc and between approximately 0.1 and 4 percent by weight nickel as an alloy. The amount of nickel in the alloy electrodeposit is preferably from about 1 to about 3 percent by weight and such as to provide good receptivity to subsequent chromate post treatment.

It should be understood, of course, that the foregoing relates only to preferred embodiments of the present invention and that numerous modifications or alterations may be made therein without departing from the spirit and scope of the invention as set forth in the appended claims.

I claim:

1. A process for applying to a workpiece a bright zinc-nickel alloy electroplated deposit having superior corrosion resistance, said process comprising:

(1) preparing an aqueous bath comprising, on a per liter basis:

(a) a soluble zinc compound providing 30 to 100 grams of zinc as metal and selected from the group consisting of zinc chloride and zinc oxide;

(b) a soluble nickel salt providing up to 10 grams of nickel as a metal, said soluble nickel salt being nickel chloride;

(c) an ammoniated electrolyte providing up to 5 grams of ammonium ions, said ammoniated electrolyte being ammonium chloride;

(d) a non-ammoniated electrolyte selected from the group consisting of potassium chloride and sodium chloride, said non-ammoniated electrolytes providing 25 to 300 grams of chloride ions;

(e) 5–50 grams of polyoxyalkylated surfactant selected from the group consisting of:

block copolymers of ethylene oxide and linear alcohols having the following structure formula;

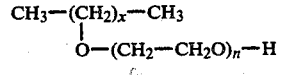

wherein x is an integer from 9 to 15 and n is an integer from 10 to 50;

block copolymers of ethylene oxide and phenol alcohols having the following structural formula;

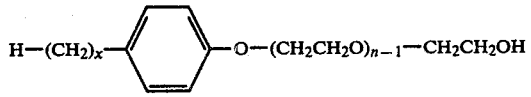

wherein x is an integer from 6 to 15 and n is an integer from 10 to 50;

block copolymers of ethylene oxide and monothanol amine coconut fatty acid condensate;

alkoxylated alkyl phenols, alkoxylated alkyl naphthols, alkoxylated aliphatic monohydric alcohols, alkoxylated polyoxypropylene glycols, alkoxylated 2,4,7,9,-tetramethyl-5-decyne-4,7-diol, alkoxylated ethylene diamine, alkoxylated fatty acids, alkoxylated amides, alkoxylated esters; and (f) 0.05-4 grams of an aromatic carbonyl brightener;

(g) 10-40 grams of boric acid; and (h) 1.5-15 grams of an aromatic carboxylic acid;

(2) maintaining acid conditions in the bath with a pH of at least 3;

(3) maintaining said bath at a temperature of from about 10° to about 30° C.;

(4) causing codeposition of the nickel and zinc to form a zinc-nickel alloy electrodeposit on the workpiece; and (5) controlling the amount of nickel ions during operation of the bath to limit the deposition of nickel and to cause deposition of a zinc-nickel alloy electroplate containing at least 96 percent by weight of zinc and an amount of nickel from 0.1 to 4 percent by weight effective to provide superior corrosion resistance.

2. A process according to claim 1, wherein said bath is substantially free of ammonium ions and has a pH from about 3.0 to about 4.5 and contains at least 0.5 grams per liter of an aromatic aldehyde and at least 3 grams per liter of nickel chloride.

3. A process for applying to a workpiece a bright zinc-nickel alloy electroplated deposit having superior corrosion resistance, said process comprising:

(1) preparing an aqueous bath comprising, on a per liter basis:

(a) a soluble zinc compound providing 30 to 100 grams of zinc as metal and selected from the group consisting of zinc chloride and zinc oxide;

(b) a soluble nickel salt providing up to 10 grams of nickel as a metal, said soluble nickel salt being nickel chloride;

(c) an ammoniated electrolyte providing 1–10 grams of ammonium ions, said ammoniated electrolyte being ammonium chloride;

(d) a buffer;

(e) a non-ammoniated electrolyte selected from the group consisting of potassium chloride and sodium chloride, said non-ammoniated electrolytes providing 25 to 300 grams of chloride ions;

(f) 5-50 grams of a polyoxyalkylated surfactant selected from the group consisting of:

block copolymers of ethylene oxide and linear alcohols having the following structural formula;

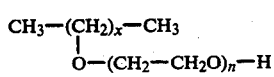

wherein x is an integer from 9 to 15 and n is an integer from 10 to 50;

block copolymers of ethylene oxide and phenol alcohols having the following structural formula;

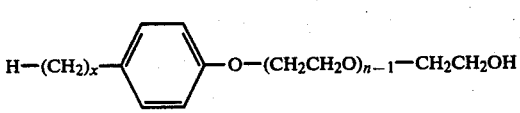

wherein x is an integer from 6 to 15 and n is an integer from 10 to 50;

block copolymers of ethylene oxide and monoethanol amine coconut fatty acid condensate;

alkoxylated alkyl phenols, alkoxylated alkyl naphthols, alkoxylated aliphatic monohydric alcohols, alkoxylated polyoxproypylene glycols, alkoxylated 2,4,7,9-tetramethyl-5-decyne-4,7-diol, alkoxylated ethylene diamine, alkoxylated fatty acids, alkoxylated amides, alkoxylated esters; and (g) 0.05–4 grams of an aromatic carbonyl compound;

(2) maintaining acid conditions in the bath with a pH of at least about 4;

(3) maintaining said bath at a temperature of at least 10° C.;

(4) causing codeposition of the nickel and zinc to form a zinc-nickel alloy electroplated deposit on the workpiece; and (5) controlling the amount of nickel ions and ammonium ions in the bath to limit the deposition of nickel and to cause deposition of a zinc-nickel alloy electroplate containing at least 96 percent by weight of zinc and an amount of nickel effective to provide superior corrosion resistance.

4. A process according to claim 3, wherein the amount by weight of ammonium ions is greater than the amount of nickel ions.

5. An electroplating process comprising preparing an aqueous acid plating bath containing, on a per liter basis, a soluble zinc compound providing 30 to 100 grams of zinc as metal and selected from the group consisting of zinc chloride and zinc oxide; an effective amount of a soluble nickel salt providing up to 10 grams of nickel as a metal, said nickel salt being nickel chloride; a non-ammoniated electrolyte providing 25 to 300 grams of chloride ions, said electrolyte being selected from the group consisting of potassium chloride and sodium chloride; a minor amount of an ammoniated electrolyte providing at least 5 grams of ammonium ions, said ammoniated electrolyte being ammonium chloride; from 5 to 50 grams of a polyoxyethylene surfactant; and from 0.05 to 4 grams of an aromatic carbonyl brightener; maintaining the bath under acid conditions with a pH of at least 3; controlling the amounts of nickel and ammonium ions to limit the rate of deposition of nickel; and simultaneously limiting the difference in the deposition potentials of the nickel and zinc to cause codeposition of nickel and zinc and formation on the surface of the workpiece of a bright zinc-nickel alloy electroplate containing at least 96 percent by weight of zinc and an amount of nickel from 0.1 to 4 percent by weight such that the electrodeposit has vastly improved corrosion resistance.

6. A process according to claim 3 or claim 5 wherein the amount of said ammoniated electrolyte is from 5 to 10 grams.

7. A process according to claim 3 or claim 5, wherein the amount of said nickel salt is from 1 to 10 grams.

8. A process according to claim 7 wherein the electrolyte is predominantly potassium chloride and is present in the bath in an amount of at least 180 grams per liter.

9. A process according to claim 8 wherein the pH of the bath during plating is at least 4 and the bath is controlled to limit the amount of nickel consumed and to provide a zinc-nickel alloy electroplate with an alloy nickel content of from about 0.1 to about 4 percent.

10. A process according to claim 8 wherein the amount of the nickel salt is at least 3 grams per liter, and the amount of the zinc compound is at least 50 grams per liter.

11. A process according to claim 7 wherein the pH of the bath is from about 3 to about 4.5 and the amounts of the nickel and ammonium ions are controlled to provide bright alloy electrodeposits containing from about 1 to about 3 percent by weight of nickel.

12. A process according to claim 7 wherein said surfactant is a nonionic polyoxyalkylated compound containing at least 15 alkylene oxide groups in the molecule.

13. A process according to claim 7 wherein the bright zinc-nickel alloy electrodeposit on the workpiece has an alloy nickel content of at least about 1 percent by weight and is provided with a subsequent chromate conversion coating.

14. A process according to claim 3 or claim 5, wherein said surfactant comprises an interpolymer of ethylene oxide and propylene oxide.

15. A process according to claim 3 or claim 5, wherein the chloride ion concentration is maintained at at least 200 grams per liter during operation of the bath.

16. A process according to claim 3 or claim 5, wherein the zinc compound provides from about 50 to about 80 grams per liter of zinc.

17. A process according to claim 3 or claim 5, wherein the amount by weight of nickel in the bath is at least 3 grams per liter and the bath is controlled to form a bright zinc nickel alloy electrodeposit containing no more than a few percent of nickel which, when subjected to chromate post treatment, has vastly improved corrosion resistance.

18. A process according to claim 3 or claim 5, wherein said bath contains at least 10 grams per liter of boric acid and from about 1.5 to about 15 grams per liter of an aromatic carboxylic acid.

* * * * *